US006015245A

United States Patent [19]

Frimm et al.

[11] Patent Number: 6,015,245

[45] Date of Patent: Jan. 18, 2000

[54] SEMISUBMERSIBLE OFFSHORE VESSEL

[76] Inventors: Fernando C. Frimm; Harris I. Knecht; Thomas D. Condon, all of 11511 Katy Freeway, Suite 200, Houston, Tex. 77079

[21] Appl. No.: 08/925,506

[22] Filed: Sep. 8, 1997

[51] Int. Cl.[7] ..... B63B 35/40; B63B 35/34; B63B 35/44

[52] U.S. Cl. ..... 405/200; 405/207; 405/208; 114/256

[58] Field of Search ..... 114/256, 264–266; 405/195.1, 197–203, 205, 207–210, 223.1

[56] References Cited

U.S. PATENT DOCUMENTS

| | | | |
|---|---|---|---|
| H000611 | 4/1989 | Peace | 114/264 |
| 2,375,286 | 5/1945 | Creed | 114/265 |
| 2,422,168 | 6/1947 | Kirby | 405/205 |
| 3,159,130 | 12/1964 | Vos | 114/256 |
| 3,391,666 | 7/1968 | Schuller | 114/122 |
| 3,407,610 | 10/1968 | Wolff | 405/205 |
| 3,490,406 | 1/1970 | O'Reilly et al. | 114/265 |
| 3,824,943 | 7/1974 | Mo | 114/264 |
| 3,830,176 | 8/1974 | Arita et al. | 114/265 |
| 3,919,957 | 11/1975 | Ray et al. | 114/265 |
| 3,921,558 | 11/1975 | Redshaw | 114/256 |
| 3,949,693 | 4/1976 | Bauer et al. | 114/265 |
| 3,986,471 | 10/1976 | Haselton | 114/265 |
| 4,112,864 | 9/1978 | Bergman | 114/265 |
| 4,232,625 | 11/1980 | Goren et al. | 114/264 |
| 4,356,789 | 11/1982 | Hammett | 114/365 |
| 4,436,050 | 3/1984 | Lidén | 114/265 |
| 4,498,412 | 2/1985 | Lidén | 114/264 |
| 5,135,327 | 8/1992 | White et al. | 405/224 |
| 5,277,521 | 1/1994 | Petkovic et al. | 405/223.1 |

FOREIGN PATENT DOCUMENTS

| | | |
|---|---|---|
| 1 212 901 | 11/1970 | United Kingdom . |
| 2 292 348 | 2/1996 | United Kingdom . |
| 2 310 634 | 9/1997 | United Kingdom . |
| 87 00138 | 1/1987 | WIPO . |

OTHER PUBLICATIONS

GVA 4000 Semi–submersible Drilling Rig (undated).

*Primary Examiner*—William Neuder
*Assistant Examiner*—Tara L. Mayo
*Attorney, Agent, or Firm*—Rosenthal & Osha L.L.P.

[57] ABSTRACT

Improvements to a ring pontoon semisubmersible vessel. The centerlines of the corner columns ar displaced with respect to the axial centerlines of the forward and aft portions of the ring pontoon. Additionally, the centerlines of the corner columns may be displaced with respect to the axial centerlines of the starboard and port portions of the ring pontoon. The superstructure deck may be supported by radial braces extending from the ring pontoon to locations on the superstructure deck which are inward of the ring pontoon.

23 Claims, 7 Drawing Sheets

SEMISUBMERSIBLE OFFSHORE VESSEL

BACKGROUND OF THE INVENTION

Various types of vessels are commonly used for drilling wells offshore, including barges, jackups, drill ships, and semisubmersibles.

Semisubmersible vessels typically have a superstructure deck or decks supported by columns which are attached to hulls or pontoons which have adjustable ballast capability. By adjusting the ballast carried by the pontoons, the pontoons may be positioned at or near the surface of the water or in a submerged location below the surface of the water, while the superstructure deck remains above the surface of the water. While being moved to a location where the vessel is to be used, the pontoons typically are ballasted to permit them to ride at or near the surface of the water, facilitating transport of the vessel. After reaching the desired location, the ballast of the pontoons may be adjusted to cause the pontoons to become submerged below the surface of the water, providing improved stability and reduced motion of the vessel in rough, deep seas. The vessel may or may not be self-propelled.

The pontoons in turn support the superstructure deck by columns which rise vertically or substantially vertically from the ring pontoon at various locations, as well as braces which may interconnect the pontoons, the pontoons and the columns, the columns and the superstructure, and/or two or more of the columns. The purpose is to provide a strong and substantially rigid base structure to support the deck(s) of the superstructure.

The interior of both the columns and the pontoons may be subdivided by bulkheads to strengthen the structure, to provide enclosed spaces for locating and storing various equipment (e.g., anchors, chains, propulsion mechanisms, etc.), and to provide a plurality of separate tanks for purposes of ballasting the vessel and storing various fluids and other materials which may be required or desired during drilling or produced by the well.

The columns typically have been placed such that the vertical centerline of the columns intersects the axial centerline of the starboard or port pontoon on which the column is located. In a ring pontoon semisubmersible vessel previously proposed, the four corner columns have been placed such that the vertical centerline of the columns intersects the axial centerline of the forward or aft pontoon as well.

SUMMARY OF THE INVENTION

The present invention relates to improvements in ring pontoon semisubmersible vessels.

In one embodiment of the present invention, the columns are located such that the centerline of the column is displaced from the axial centerline of the forward and aft sections of the ring pontoon. A vertical partition in each column lies in the same plane as, and therefore forms an extension of, the interior side of either the forward or the aft section of the pontoon ring.

In another embodiment of the invention, the columns also are located such that the centerline of the column is displaced from the axial centerline of the starboard and port sections of the ring pontoon.

DESCRIPTION OF THE PREFERRED EMBODIMENTS

This invention relates to improvements to ring pontoon semisubmersible vessels.

Figure 1:
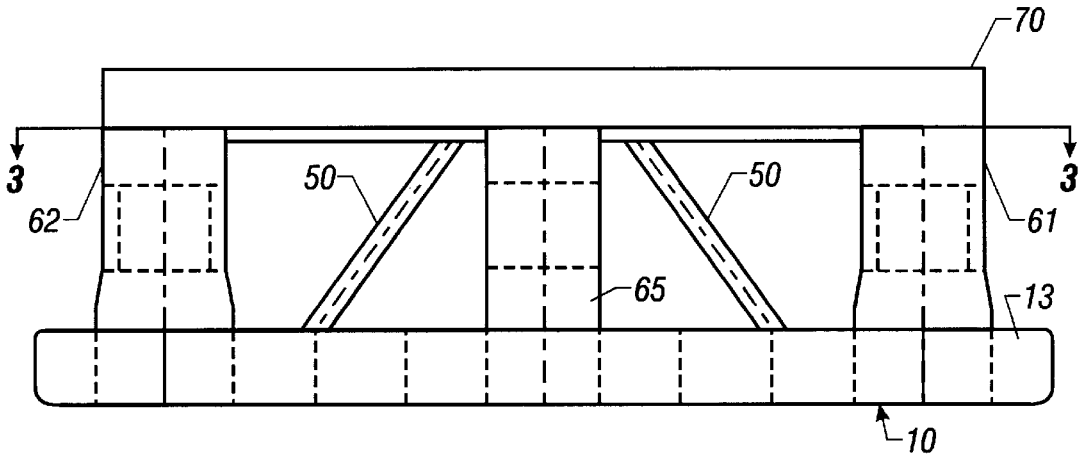
FIGS. 1, 2, and 3 are the side elevation, cross section, and plan views respectively of one embodiment of the invention.
Figure 2:
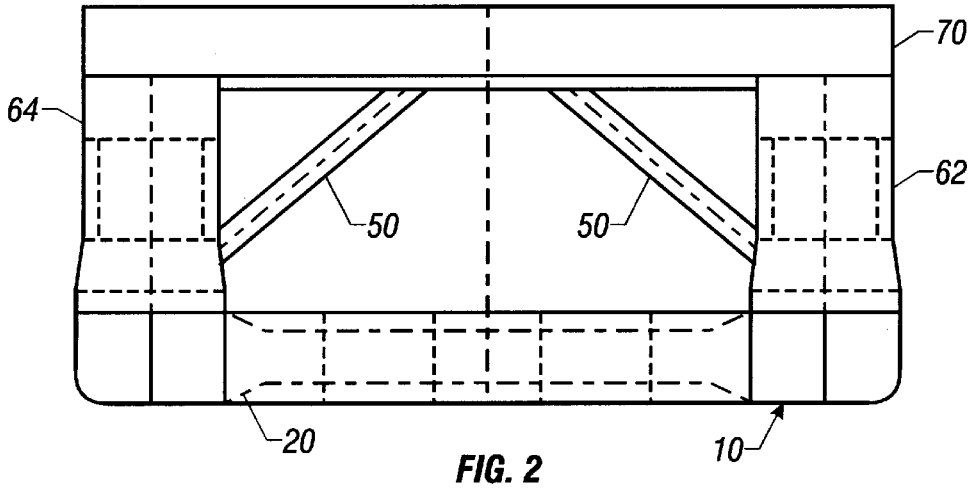
Figure 3:
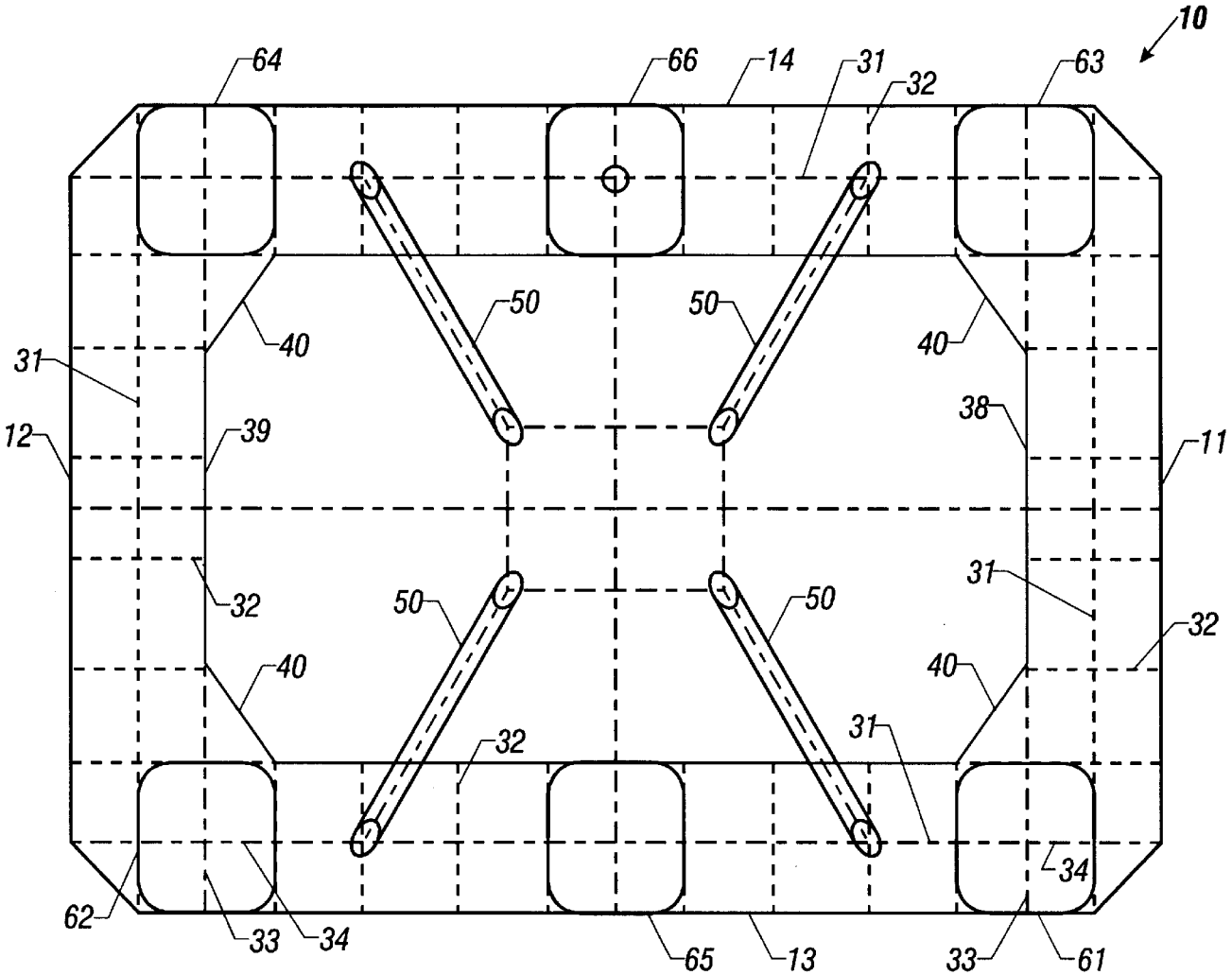

In a ring pontoon vessel such as is shown in FIGS. 1, 2, and 3, the forward, aft, starboard, and port pontoons 11, 12, 13, and 14, respectively, form a ring 10. The shape of the ring is not required to be circular, and typically is either substantially square or rectangular, although other shapes (e.g., hexagonal, octagonal, etc.) are possible. The ring 10 shown in FIG. 3 may be considered to be substantially rectangular, or may be considered to be octagonal.

The vertical cross section of the ring is either substantially square or rectangular. Other cross sectional shapes (e.g., octagonal, etc.) are possible. The vertical cross-section of the starboard pontoon 13 and the port pontoon 14 is substantially rectangular, having curved edges. While the vertical cross section of the ring may be symmetrical, that is not required.

Figure 4A:
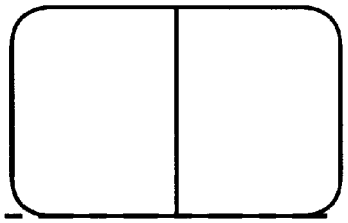
FIGS. 4A, 4B, 4C, and 4D show exemplary centerline vertical cross sections of the ring pontoon in various embodiments and at various locations along the ring pontoon.
Figure 4B:
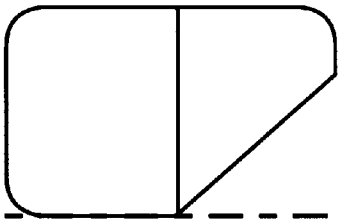
Figure 4C:
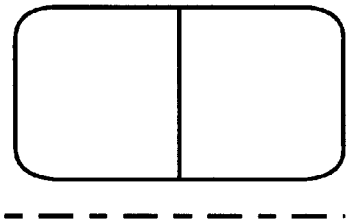
Figure 4D:
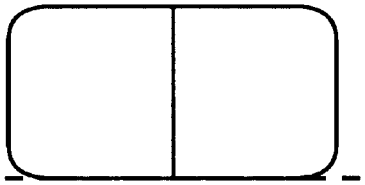

Moreover, the vertical cross section of the ring 10 may vary from location to location along the longitudinal axis of the ring. For example, as shown in FIG. 4, the vertical cross section of the forward pontoon 11 and/or the aft pontoon 12 may be substantially different from the vertical cross section of either the starboard or port pontoons 13 and 14. FIG. 4A is representative of a centerline vertical cross section for the starboard and port pontoons 13 and 14, and also may represent the centerline vertical cross section for the forward and aft pontoons 11 and 12. Alternatively, either or both of the forward and aft pontoons may have a significantly different vertical cross section. Examples of alternative centerline vertical cross sections are shown in FIGS. 4B, 4C, and 4D, which represent a "barge bow" cross section (FIG. 4B), a raised reduced cross section (FIG. 4C), and a lowered reduced cross section (FIG. 4D). When a reduced cross section is selected for the design of the forward and/or aft pontoon, there will be a transition region 20 at which the cross section of the forward and/or aft pontoon transitions from one cross sectional shape to another.

Typically, the centerline vertical cross sections of the starboard and port pontoons, and the centerline vertical cross sections of the forward and aft pontoons, would be the same, although this is not required. Similarly, the centerline vertical cross sections of all of the pontoons may be the same.

As shown in FIG. 3, each pontoon is subdivided by at least one vertical bulkhead 31 which is parallel to the longitudinal axis of the pontoon, and may be subdivided further by one or more vertical partitions or bulkheads 32 which are transverse such axis, into various fluid tight compartments or tanks. Similarly, each column is divided by one or more vertical partitions or bulkheads 33 and 34 into multiple compartments or tanks. These partitions or bulkheads also contribute to the structural strength and rigidity of the pontoons and the columns.

Also shown in FIG. 3 are four additional tanks or compartments 40 which have been formed, one at each of the interior corners of the ring 10. These additional tanks or compartments further reinforce and become part of the ring 10.

As shown in FIG. 3, the vessel uses at least four corner columns 61, 62, 63, and 64, which are connected to the pontoon ring 10 near the forward and aft ends of the starboard and port pontoons, respectively. Additional columns, such as columns 65 and 66, also may be used if desired. The columns support the superstructure deck 70, as shown in FIGS. 1 and 2, above the pontoon ring 10.

Additional braces 50 may extend radially inward from the ring pontoon 10 to locations on the superstructure deck 70 located inwardly of the ring pontoon 10, and serve to further reinforce and strengthen the vessel.

In one embodiment of the invention, each the corner columns 61, 62, 63, and 64 are located at positions on the ring which permit at least one of the interior vertical bulkheads of such column to be in the same plane as either the interior or exterior surface of the pontoon. As shown in FIG. 3, vertical bulkhead 33 in each of the four corner columns lies in the same plane as the interior surface 38 of the forward pontoon or interior surface 39 of the aft pontoon. This permits the vertical bulkhead 33 to be formed as an extension of the interior surface 38 of the forward pontoon or interior surface 39 of the aft pontoon.

Locating each of the four corner columns as described permits the center of each of such column to be displaced horizontally from the axial centerline of the forward and aft pontoons, while taking advantage of the structural integrity which results from having a vertical surface of the pontoon be contiguous with and extend into one of the interior vertical bulkheads in the column. By displacing the center of the corner columns horizontally from the axial centerline of the forward and aft pontoons, movement of the superstructure deck due to wave motion is reduced.

Figure 5:
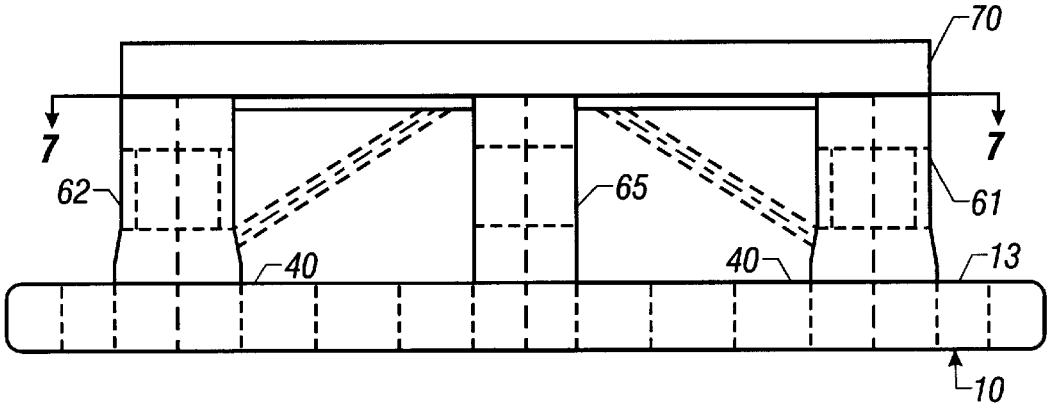
FIGS. 5, 6, and 7 are the side elevation, cross section, and plan views respectively of another embodiment of the invention.
Figure 6:
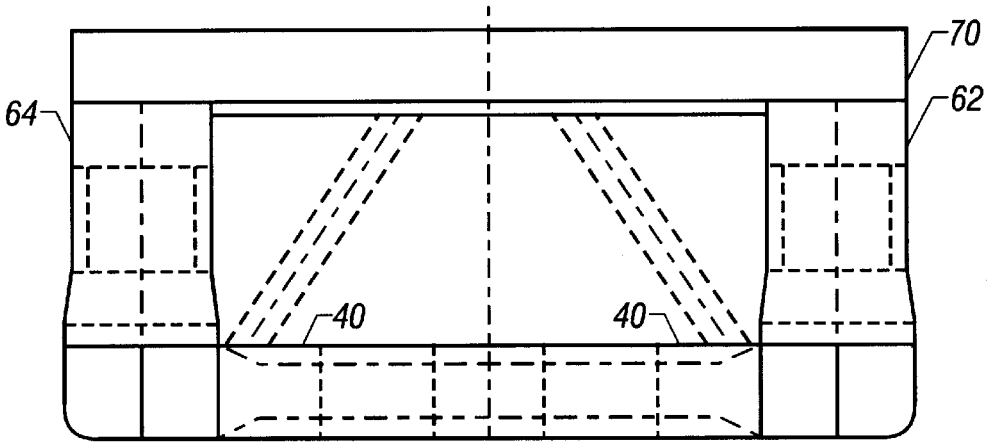
Figure 7:
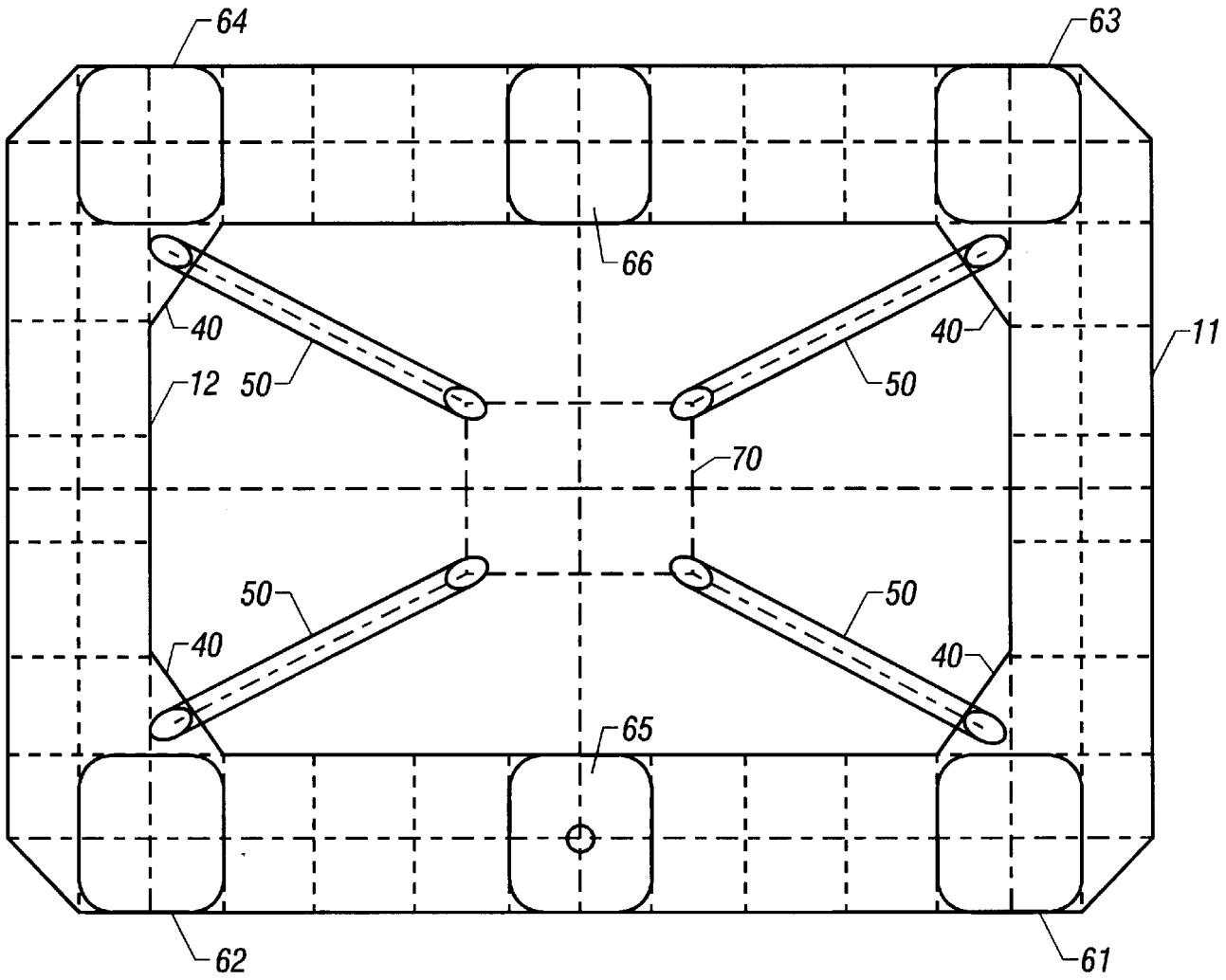

In another embodiment of the invention shown in FIGS. 5, 6, and 7, the positions of the columns are displaced even more, such that an exterior vertical surface of the column lies in the same plane as the opposite surface of either the forward or aft pontoon. Thus, the most forward surface of the column 61 is in the same plane as the most aft vertical surface of the forward pontoon 11, and the most aft surface of the column 62 is in the same plane as the most forward vertical surface of the aft pontoon 12.

In the embodiment shown in FIGS. 5 6, and 7, braces 50 extend from each of the corner tanks or compartments 40 to the deck of the superstructure 70.

Figure 8:
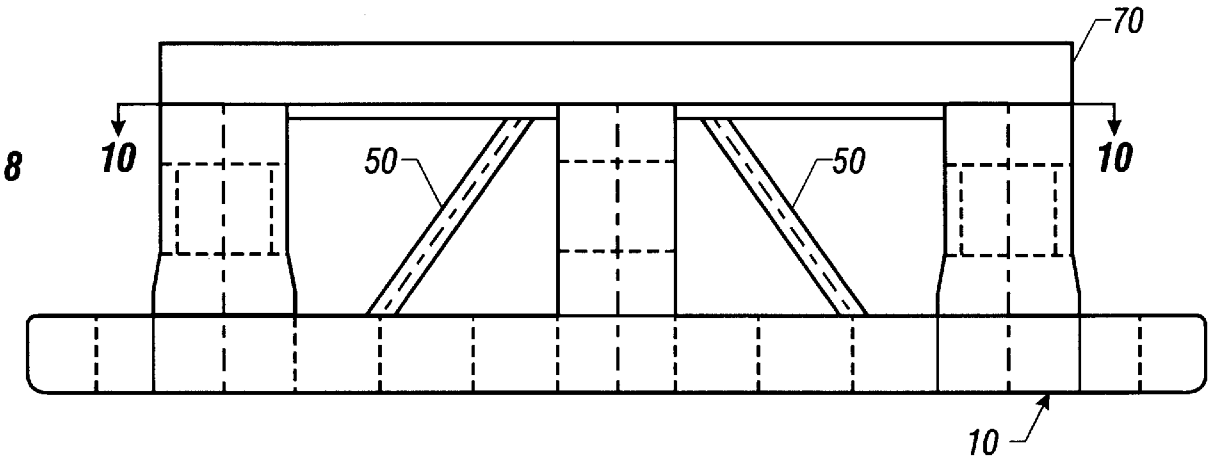
FIGS. 8, 9, and 10 are the side elevation, cross section, and plan views respectively of yet another embodiment of the invention.
Figure 9:
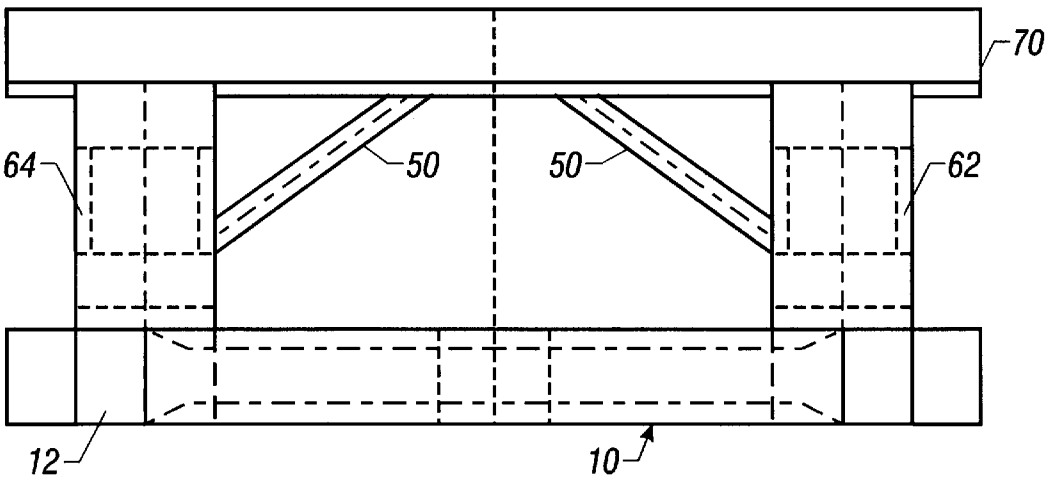
Figure 10:
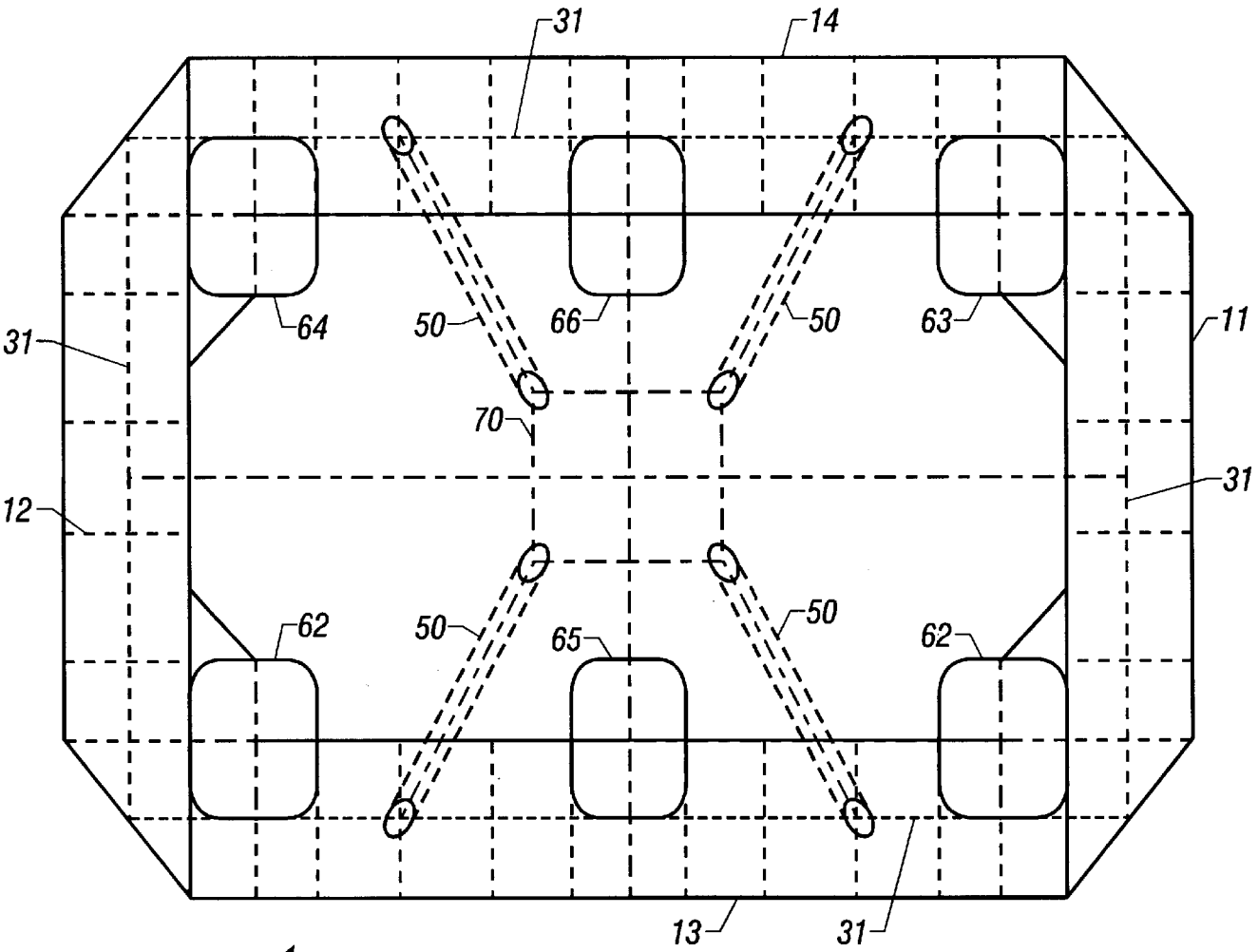

In yet another embodiment of the invention shown in FIGS. 8, 9, and 10, the positions of the four corner columns have been displaced not only from the axial centerlines of the forward and aft pontoons, but also from the axial centerlines of the starboard and port pontoons. This permits even further reduction of the movement of the superstructure deck due to wave action, while retaining a very strong and rigid base structure.

What is claimed is:

1. A semisubmersible vessel comprising:

(a) a superstructure deck;

(b) a ring pontoon having forward, aft, starboard, and port sections;

(c) said superstructure deck is supported by at least four columns located near the forward and aft ends of the starboard and port sections of the ring pontoon; and (d) the vertical centerline of each of the columns is located inward of both the axial centerline of the forward section of the ring pontoon and the axial centerline of the aft section of the ring pontoon.

2. A semisubmersible vessel according to claim 1 in which the outer perimeter of the ring pontoon forms an octagon.

3. A semisubmersible vessel according to claim 1 in which the inner perimeter of the ring pontoon forms an octagon.

4. A semisubmersible vessel according to claim 1 in which the superstructure deck is further supported by at least four radial braces running from the ring pontoon to locations on the superstructure deck which are inboard of the ring pontoon.

5. The semisubmersible vessel of claim 1, wherein the vertical centerline of each of the columns is located inward of the axial centerlines of the starboard and port sections of the ring pontoon.

6. The semisubmersible vessel of claim 5, further comprising a plurality of compartments each formed between adjacent sections of the ring pontoon, wherein a side of each of said at least four columns is formed as an extension of a side of the adjacent compartment.

7. The semisubmersible vessel of claim 1, wherein said forward and aft sections of the ring pontoon have a reduced sectional height compared with the starboard and port sections of the ring pontoon.

8. The semisubmersible vessel of claim 1, wherein the ring pontoon is non-square.

9. The semisubmersible vessel of claim 8, wherein an outer perimeter of the ring pontoon forms an octagon.

10. The semisubmersible vessel according to claim 1 wherein each of the at least four columns includes a first vertical centerline partition lying in the same plane as a side of either the forward or aft section of the ring pontoon.

11. The semisubmersible vessel according to claim 10 wherein the at least four columns further comprise a second vertical partition transverse to the first vertical partition and which lines in the same plane as a vertical interior partition in either the starboard or port section of the ring pontoon.

12. A semisubmersible vessel comprising:

(a) a superstructure deck;

(b) a ring pontoon having forward, aft starboard and port sections;

(c) the superstructure deck is supported by at least four columns located near the forward and aft ends of the starboard and port sections of the ring pontoon; and (d) the vertical centerline of each of the at least four columns is located inward of both the axial centerline of the port section of the ring pontoon and the axial centerline of the starboard section of the ring pontoon.

13. The semisubmersible vessel according to claim 12, wherein each of the at least four columns includes a first vertical centerline partition lying in the same plane as a side of either the starboard or port section of the ring pontoon.

14. The semisubmersible vessel according to claim 13, wherein the first interior vertical partition in each of the at least four columns is formed as an extension of the side of either the starboard or port section of the ring pontoon.

15. The semisubmersible vessel according to claim 12, wherein the at least four columns further comprise a second vertical partition transverse to the first vertical partition and which lies in the same plane as a vertical interior partition in either the forward or aft section of the ring pontoon.

16. The semisubmersible vessel according to claim 12, in which the outer perimeter of the ring pontoon forms an octagon.

17. The semisubmersible vessel according to claim 12, in which the inner perimeter of the ring pontoon forms an octagon.

18. The semisubmersible vessel according to claim 12, in which the superstructure deck is further supported by at least four radial braces extending from the ring pontoon to locations on the superstructure deck which are inboard of the ring pontoon.

19. The semisubmersible vessel according to claim 12, wherein the vertical centerline of each of the at least four columns is located inward of the axial centerlines of the forward and aft sections of the ring pontoon.

20. The semisubmersible vessel according to claim 19, further comprising a plurality of compartments each formed between adjacent sections of the ring pontoon wherein a side of each of the at least four columns is formed as an extension of a side of the adjacent compartment.

21. The semisubmersible vessel according to claim 12, wherein the starboard and aft sections of the ring pontoon have reduced sectional height compared with the forward and aft sections of the ring pontoon.

22. The semisubmersible vessel according to claim 12, wherein the ring pontoon is non-square.

23. The semisubmersible vessel according to claim 22, wherein the outer perimeter of the ring pontoon forms an octagon.

* * * * *

US006015245C1

(12) EX PARTE REEXAMINATION CERTIFICATE (5392nd)

United States Patent
Frimm et al.

(10) Number: US 6,015,245 C1
(45) Certificate Issued: Jun. 6, 2006

(54) SEMISUBMERSIBLE OFFSHORE VESSEL

(75) Inventors: Fernando C. Frimm, Houston, TX (US); Harris I. Knecht, Houston, TX (US); Thomas D. Condon, Houston, TX (US)

(73) Assignee: Exmar Offshore Company, Houston, TX (US)

Reexamination Request:
No. 90/005,991, Apr. 30, 2001

Reexamination Certificate for:

| | |
|---|---|
| Patent No.: | **6,015,245** |
| Issued: | **Jan. 18, 2000** |
| Appl. No.: | **08/925,506** |
| Filed: | **Sep. 8, 1997** |

(51) Int. Cl.

| | |
|---|---|
| ***B63B 35/40*** | (2006.01) |
| ***B63B 35/34*** | (2006.01) |
| ***B63B 35/44*** | (2006.01) |

(52) U.S. Cl. ..... 405/200; 405/207; 405/208; 114/256

(58) Field of Classification Search ..... None
See application file for complete search history.

(56) References Cited

U.S. PATENT DOCUMENTS

| | | | | |
|---|---|---|---|---|
| 2,375,286 | A | | 5/1945 | Creed |
| 2,422,168 | A | | 6/1947 | Kirby |
| 3,159,130 | A | | 12/1964 | Vos |
| 3,391,666 | A | | 7/1968 | Schuller |
| 3,407,610 | A | | 10/1968 | Wolff |
| 3,490,406 | A | | 1/1970 | O'Reilly et al. |
| 3,824,943 | A | | 7/1974 | Mo |
| 3,830,176 | A | | 8/1974 | Arita et al. |
| 3,919,957 | A | | 11/1975 | Ray et al. |
| 3,921,558 | A | | 11/1975 | Redshaw |
| 3,949,693 | A | | 4/1976 | Bauer et al. |
| 3,986,471 | A | | 10/1976 | Haselton |
| 4,112,864 | A | | 9/1978 | Bergman |
| 4,232,625 | A | | 11/1980 | Goren et al. |
| 4,356,789 | A | | 11/1982 | Hammet |
| 4,436,050 | A | | 3/1984 | Liden |
| 4,498,412 | A | | 2/1985 | Liden |
| H611 | H | | 4/1989 | Peace |
| 5,036,782 | A | * | 8/1991 | Linde et al. ..... 114/265 X |
| 5,135,327 | A | | 8/1992 | White et al. |
| 5,277,521 | A | | 1/1994 | Petkovic et al. |

FOREIGN PATENT DOCUMENTS

| | | |
|---|---|---|
| GB | 1212901 | 11/1970 |
| GB | 2292348 | 2/1996 |
| GB | 2310634 | 9/1997 |
| WO | WO 8700138 | 1/1987 |

OTHER PUBLICATIONS

GVA 4000 Semi–Submersible Drilling Rig (undated).
GVA FPS Floating Production Systems (Published prior to 1990).

* cited by examiner

*Primary Examiner*—Sunil Singh

(57) ABSTRACT

Improvements to a ring pontoon semisubmersible vessel. The centerlines of the corner columns ar displaced with respect to the axial centerlines of the forward and aft portions of the ring pontoon. Additionally, the centerlines of the corner columns may be displaced with respect to the axial centerlines of the starboard and port portions of the ring pontoon. The superstructure deck may be supported by radial braces extending from the ring pontoon to locations on the superstructure deck which are inward of the ring pontoon.

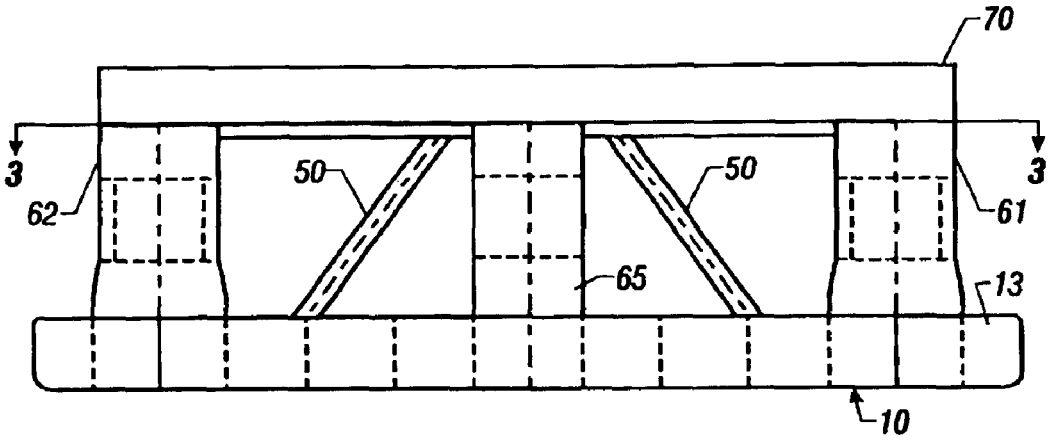

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4 and 18 are cancelled.

Claims 1 and 12 are determined to be patentable as amended.

Claims 2–3, 5–11, 13–17 and 19–23, dependent on an amended claim, are determined to be patentable.

New claims 24–35 are added and determined to be patentable.

1. A semisubmersible vessel comprising:

(a) a superstructure deck;

(b) a ring pontoon having forward, aft, starboard and port sections;

(c) said superstructure deck is supported by at least four columns located near the forward and aft ends of the starboard and port sections of the ring pontoon; and (d) the vertical centerline of each of the columns is located inward of both the axial centerline of the forward section of the ring pontoon and the axial centerline of the aft section of the ring pontoon, *the superstructure deck further supported by at least four radial braces running from the ring pontoon to locations on the superstructure deck which are inboard of the ring pontoon*.

12. A semisubmersible vessel comprising:

(a) a superstructure deck;

(b) a ring pontoon having forward, aft, starboard and port sections;

(c) said superstructure deck is supported by at least four columns located near the forward and aft ends of the starboard and port sections of the ring pontoon; and (d) the vertical centerline of each of the at least four columns is located inward of both the axial centerline of the port section of the ring pontoon and the axial centerline of the starboard section of the ring pontoon, *the superstructure deck further supported by at least four radial braces running from the ring pontoon to locations on the superstructure deck which are inboard of the ring pontoon*.

*24. A semisubmersible vessel comprising:*

*(a) a superstructure deck;*

*(b) a ring pontoon having forward, aft, starboard and port sections;*

*(c) said superstructure deck is supported by at least four columns located near the forward and aft ends of the starboard and port sections of the ring pontoon; and*

*(d) the vertical centerline of each of the columns is located inward of both the axial centerline of the forward section of the ring pontoon and the axial centerline of the aft section of the ring pontoon, the vertical centerlines of each of the columns is located inward of the axial centerlines of the starboard and port sections of the ring pontoon, and wherein a plurality of compartments is formed between adjacent sections of the ring pontoon, a side of each of the least four columns is formed as an extension of a side of the adjacent compartment,*

*wherein said superstructure is further supported by at least four radial braces running from the ring pontoon to locations on the superstructure deck which are inboard of the ring pontoon.*

*25. A semisubmersible vessel comprising:*

*(a) a superstructure deck;*

*(b) a ring pontoon having forward, aft, starboard and port sections;*

*(c) said superstructure deck is supported by at least four columns located near the forward and aft ends of the starboard and port sections of the ring pontoon; and*

*(d) the vertical centerline of each of the columns is located inward of both the axial centerline of the forward section of the ring pontoon and the axial centerline of the aft section of the ring pontoon, each of the at least four columns includes a first vertical centerline partition lying in the same plane as a side of either the forward or aft section of the ring pontoon,*

*wherein the at least four columns each includes a second vertical partition transverse to the first vertical partition and which lies in the same plane as a vertical interior partition in either the starboard or port section of the ring pontoon.*

*26. The semisubmersible vessel of claim 25 wherein the superstructure deck is further supported by at least four radial braces running from the ring pontoon to locations on the superstructure deck which are inboard of the ring pontoon.*

*27. The semisubmersible vessel of claim 26 wherein the first vertical partition of each of the at least four columns is formed as an extension of the side of either the forward or aft section of the ring pontoon.*

*28. A semisubmersible vessel comprising:*

*(a) a superstructure deck;*

*(b) a ring pontoon having forward, aft, starboard and port sections;*

*(c) said superstructure deck is supported by at least four columns located near the forward and aft ends of the starboard and port sections of the ring pontoon; and*

*(d) the vertical centerline of each of the at least four columns is located inward of both the axial centerline of the port section of the ring pontoon and the axial centerline of the starboard section of the ring pontoon, each of the at least four columns includes a first vertical centerline partition lying in the same plane as a side of either the starboard or port section of the ring pontoon,*

*wherein the superstructure deck is further supported by at least four radial braces running from the ring pontoon to locations on the superstructure deck which are inboard of the ring pontoon.*

*29. The semisubmersible vessel of claim 28 wherein the first vertical partition of each of the at least four columns is formed as an extension of the side of either the starboard or port section of the ring pontoon.*

*30. A semisubmersible vessel comprising:*

(*a*) *a superstructure deck;*

(*b*) *a ring pontoon having forward, aft, starboard and port sections;*

(*c*) *said superstructure deck is supported by at least four columns located near the forward and aft ends of the starboard and port sections of the ring pontoon; and*

(*d*) *the vertical centerline of each of the columns is located inward of both the axial centerline of the forward section of the ring pontoon and the axial centerline of the aft section of the ring pontoon, an exterior vertical surface of at least one of the columns lying in the same plane as the most aft surface of the forward section of the ring pontoon or the most forward surface of the aft section of the ring pontoon.*

*31. The semisubmersible vessel of claim 30 wherein the superstructure deck is further supported by at least four radial braces running from the ring pontoon to locations on the superstructure deck which are inboard of the ring pontoon.*

*32. A semisubmersible vessel comprising:*

(*a*) *a superstructure deck;*

(*b*) *a ring pontoon having forward, aft, starboard and port sections;*

(*c*) *said superstructure deck is supported by at least four columns located near the forward and aft ends of the starboard and port sections of the ring pontoon;*

(*d*) *the vertical centerline of each of the columns is located inward of both an axial centerline of the forward section of the ring pontoon and an axial centerline of the aft section of the ring pontoon; and*

(*e*) *at least one radial brace running from the ring pontoon to a location on the superstructure deck which is inboard of the ring pontoon.*

*33. The semisubmersible vessel of claim 32, further comprising at least one additional column supporting the superstructure deck.*

*34. A semisubmersible vessel comprising:*

(*a*) *a superstructure deck;*

(*b*) *a ring pontoon having forward, aft, starboard and port sections;*

(*c*) *at least four corner columns located near the fore and aft ends of the starboard and port sections of the ring pontoon supporting the superstructure deck;*

(*d*) *the vertical centerline of each of the at least four corner column is located inward of both an axial centerline of the port section of the ring pontoon and an axial centerline of the starboard section of the ring pontoon; and*

(*e*) *at least one radial brace running from the ring pontoon to a location on the superstructure deck which is inboard of the ring pontoon.*

*35. The semisubmersible vessel of claim 34, further comprising at least one additional column supporting the superstructure deck.*

* * * * *